United States Patent [19]

Hegel

[11] 4,060,241

[45] Nov. 29, 1977

[54] FRICTION TYPE EXERCISING DEVICE

[76] Inventor: Edward Hegel, 484 Park Ave., N. Merrick, N.Y. 11566

[21] Appl. No.: 732,157

[22] Filed: Oct. 13, 1976

[51] Int. Cl.[2] ..... A63B 21/22

[52] U.S. Cl. ..... 272/132; 273/DIG. 3

[58] Field of Search ..... 272/132, 131, DIG. 3, 272/DIG. 4, 143, 116, 67, 68, 73, 128, 129; 128/25 R

[56] References Cited

U.S. PATENT DOCUMENTS

| | | | |
|---|---|---|---|
| 2,668,709 | 2/1954 | Boyko | 272/73 X |
| 2,817,524 | 12/1957 | Sadler | 272/132 |
| 3,224,765 | 12/1965 | Baker et al. | 272/132 |
| 3,309,084 | 3/1967 | Simmons | 272/73 X |
| 3,751,033 | 8/1973 | Rosenthal | 272/DIG. 3 X |

FOREIGN PATENT DOCUMENTS

| | | | |
|---|---|---|---|
| 461,839 | 10/1968 | Switzerland | 272/73 |

*Primary Examiner*—William H. Grieb
*Assistant Examiner*—William R. Browne
*Attorney, Agent, or Firm*—Robert D. Farkas

[57] ABSTRACT

An exercising device utilizes a plate member pivotably and rotatably secured to a surface mounting plate. A pair of handles are eccentrically disposed outwardly from a shaft journalled to the plate. The shaft passes through an opening in the plate which partially houses a wheel fixedly secured to the shaft. A threaded rod is utilized to exert a variable drag force on the marginal edge of the wheel by applying an inwardly directed force to a bar carried at one end of the threaded rod. Positioning the plate member and locking same relative to the mounting plate permits the access of the shaft to be positioned in preferred operating locations.

2 Claims, 2 Drawing Figures

FRICTION TYPE EXERCISING DEVICE

BACKGROUND OF THE INVENTION

1. The Field of the Invention

This invention relates to manually operated excercising devices and more particularly to that class utilizing friction forces to restrain the rotation of a pair of operating handles.

2. Description of the Prior Art

The prior art abounds with manually operated hand crank exercising devices. U.S. Pat. No. 3,224,765 issued on Dec. 21, 1955 E. H. Baker et al teaches a pair of handles operating a wheel contained within a housing. The wheel is substantially encircled by a pair of semicircular brake elements which adjustably bear upon the periphery of the wheel so as to create a drag force. The housing is secured to a mounting surface, in a fixed position, utilizing three tripod-like legs therefor.

U.S. Pat. No. 3,309,084 issued on Mar. 14, 1967 to H. C. simmons discloses a hand crank operated portable exerciser utilizing a plate disposed resting on the ground and a framework extending upwardly from the plate. A wheel is journalled to the framework and is operated by a pair of hand cranks driving a chain coupled to the wheel. A brake apparatus engages a point on the surface of the periphery of the wheel and utilizes an adjustably applied force thereto acting as a brake.

Each of the aforementioned patents suffer the common deficiency of maintaining the angular relationship of the longitudinal axis of the hand crank bearing shaft fixed relative to either the mounting surface or the surface of the terrain from which the apparatus gains support. Thus, the user is precluded from operating the exerciser in a variety of hand motions and from utilizing the apparatus at selected locations relative to the point of attachment or support provided by a mounting or supporting surface.

SUMMARY OF THE INVENTION

A primary object of the present invention is to provide a hand crank operated exerciser, wherein the axis of the shaft carrying the hand cranks may be selectively positioned at desired locations relative to a surface to which the apparatus is mounted.

Another object of the present invention is to provide a frictional drag to the peripheral surface of a wheel rotated when the hand cranks are manually operated. Still another object of the present invention is to provide a means to quickly and easily adjust the amount of frictional drag.

Yet another object of the present invention is to provide an exerciser in accordance with the preceding objects, relatively inexpensive, which is simple in construction and effective for its particular purposes.

Heretofore, hand crank operated exercisers were useful in disposing the motion of the forearms of the user in a pair of circles residing in parallel vertical planes. Though the therapeutic and muscle building properties of such exercise motions are beneficial to the user, the limited mode of exercise precluded the ability of the user in excercising in other modes. Such other modes include hand over hand circular motions and circular motions preformed in a plane passing obliquely through the plane defined by the shoulders and chest of the user. Furthermore, prior apparatus failed to provide for a device which could be fastened to a wall mounting surface and which could be adjusted to suit the height of various users.

These objects as well as other objects of the present invention, will become more readily apparent, after reading the following description of the accompanying drawings.

DESCRIPTION OF THE PREFERRED EMBODIMENT

The structure and method of fabrication of the present invention is applicable to a circular plate having four holes passing therethrough. A first rod secured to the plate and extends outwardly and normal to a lateral surface thereof. Screws may be utilized, passing through the holes, to mount the circular plate to a wall or floor supporting surface. The other end of the ord is secured to a block having a substantial spherical shape. The block contains a hemi-spherical cavity or socket having an open mouth portion extending to the surface of the block and being disposed opposite to the point on the surface of the block to which the other end of the first rod is affixed.

A solid ball-shaped sphere has a portion of its surface engaged within the hemi-spherical cavity and the remaining portion of the surface thereof extending outwardly from the open mouth portion of the cavity. One end of a second rod is secured at a point on the remaining portion of the surface of the ball so as to have the longitudinal axis of the second rod directed radially inwardly to the center of the ball. A threaded rod, engaging a threaded hole passing through the walls of the block, is utilized to clamp the ball at a preferred pivotable and rotational position to the block, by having one end thereof touchingly engage the surface of the ball. The other end of the threaded bolt may be adapted with a knob.

The other end of the second rod is fixedly secured to a short marginal edge of an elongated plate having a substantially rectangular opening therein. The rectangular opening has marginal edges disposed paralleling the outermost marginal edges of the plate. A shaft is journalled to the elongated side of the plate and passes through the opening. A wheel is fixedly secured and co-axially aligned with the shaft located within the opening. The opposed shorter side of the plate or frame member carries another threaded hole whose longitudinal axis is directed radially towards the center of the wheel. A threaded rod is adapted to threadingly engage this threaded hole and is provided with a bar at one end thereof. The surface of the bar adjacent the periphery of the wheel is provided with an arcuately shaped contour adapted to engage a portion of the periphery of the wheel. The other end of the threaded rod is provided with a knob-like handle which when rotated disposes the bar inwardly towards the surface of the wheel so as to create a variable drag to be exerted thereupon.

By loosening the threaded bolt residing in the threaded hole in the block, the user may position the longitudinal axis of the shaft at desired locations relative to the circular mounting plate.

Figure 1:
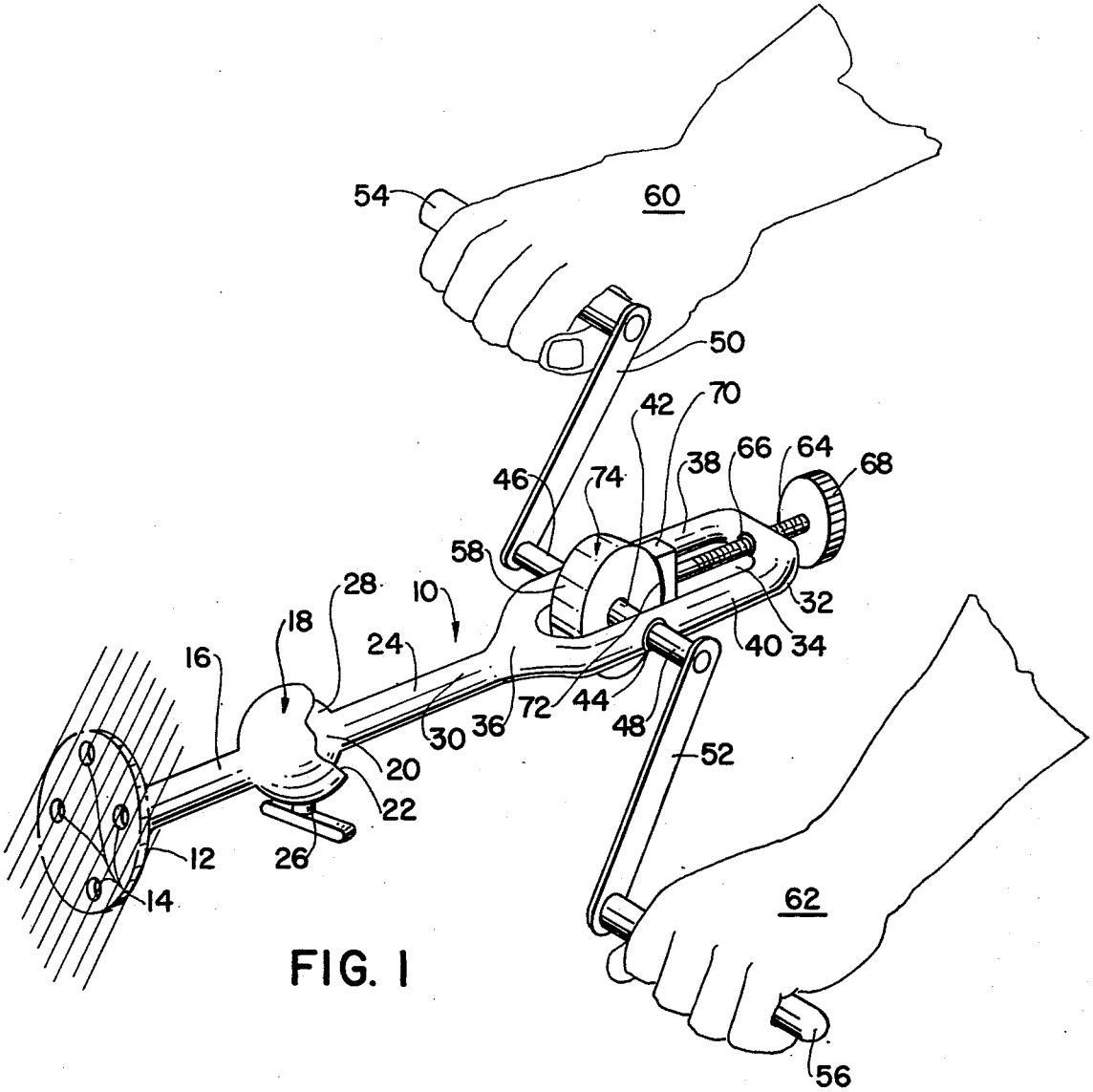
FIG. 1 is a perspective view of the present invention.

Now referring to the figures and more particularly to the embodiment illustrated in FIG. 1 showing the present invention 10 comprising a circular plate 12 having holes 14 disposed in the lateral surfaces thereof. Rod 16 is shown extending outwardly from plate 12 and has block 18 secured thereto. Ball 20 partially resides within hemi-spherical cavity 22 and has rod 24 secured to the exposed surface of ball 20. Threaded bolt 26 is adapted engaging the threaded hole, not shown, resided in touching engagement with the portion of the surface of ball 20 captured within cavity 22. Cavity 22 is provided with an open mouth portion 28 through which rod 24 passes. End 30 of rod 24 is secured to frame member 32 having an elongated opening 34 therein. End 30 is secured to a first marginal edge 36 disposed at one end and intermediate sdies 38 and 40. Shaft 42 passes through sides 38 and 40, being journalled therewith utilizing sleeve bearing 44. The outermost ends 46 and 48 of shaft 42 engage cranks 50 and 52 having eccentrically disposed handles 54 and 56 at the ends thereof. Wheel 58 is co-axially aligned and secured to shaft 42 and is rotated when shaft 42 is rotated by the reciprocating circular motion of hand 60 and 62. Threaded rod 64 is shown threadingly engaging hole 66 in the opposed marginal edge of frame 32. Knob 68 is fixed to one end of threaded rod 64 and is shown located outwardly of frame 32. The other end of rod 64 carries bar 70 having an arcuately shaped surface 72 shown engaging the periphery 74 of wheel 58.

Figure 2:
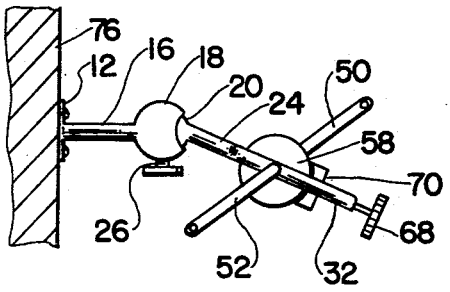
FIG. 2 is a side elevation view of the present invention.

FIG. 2 shows circular plate 12 secured to a mounting surface 76 which, though shown disposed in a vertical plane, may, if desired, be a horizontal supporting surface such as a floor. Rod 16 is shown forming an obtuse anlge with rod 24 due to the swivel action obtained between block 18 and ball 20.

Figure 3:
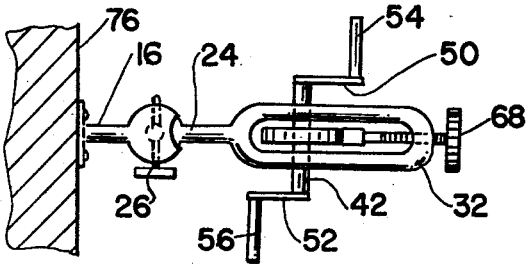
FIG. 3 is a plan view of the present invention.

FIG. 3 illustrates mounting surface 76 shown supporting rod 18 outwardly therefrom. Rod 24 is shown rotated ninety degrees relative to the angular position shown in FIG. 2 such that shaft 42 is disposed in a vertical direction permitting handles 54 and 56 to be operated one above the other. Threaded bolt 26 is utilized to maintain frame 32 in the position shown.

One of the advantages of the present invention is a hand crank operated exerciser, wherein the axis of the shaft carrying the hand cranks may be selectively positioned at desired locations relative to a surface to which the apparatus is mounted.

Another advantage of the present invention is a frctional drag to the peripheral surface of a wheel rotated when the hand cranks are manually operated.

Still another advantage of the present invention is a hand crank operated exerciser with means to quickly and easily adjust the amount of frictional drag.

Yet another advantage of the present invention is an exerciser in accordance with the preceding advantages, which is simple in construction, relatively inexpensive and effective for its particular purposes.

Thus there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

I claim:

1. An exercising device comprising a wheel, a frame, said frame including an elongated plate and a rod, one end of the rod fixedly secured to a first marginal edge of the plate, the wheel being disposed journalled to opposed sides of an opening located in the frame, the first marginal edge being disposed intermediate said opposite sides, a shaft, the shaft co-axially aligned with an fixedly secured to the wheel extending outwardly from the frame, a pair of handles fixedly secured eccentrically to the ends of the shaft, means to apply a variable magnitude drag force on the periphery of the wheel, said drag force applying means including a threaded rod, one end of the threaded rod carrying a bar, the bar having a portion of the outer surface thereof arcuately shaped disposed in touching engagement with a portion of the periphery of the wheel, the other end of the threaded rod having a handle fixedly secured thereto, the frame having a threaded hole disposed in a second marginal edge of the plate, the second marginal edge being disposed intermediate said sides and opposite to said first marginal edge, a portion of the threaded rod being disposed in threaded engagement with the threaded hole, the portion of the threaded rod including a portion of the rod intermediate the handle and the bar, said fastening means includes a circular plate, the circular plate having a plurality of holes therein, a plurality of screws, said plurality of holes having said plurality of screws passing therethrough for mounting said circular plate to said mounting surface, means to adjustably position including a block, the block having a hemisperhical socket disposed therewithin, the socket having an open mouth portion disposed in the surface of the block, a ball, a portion of the surface of the ball being disposed captured within the socket, the rod being disposed fixedly secured to another portion of the surface of the ball and passing through the open mouth portion, the block being disposed fixedly secured to the circular plate, means to releasingly clamp the ball to the block, means to adjustably position the longitudinal axis of the shaft relative to a stationary mounting surface, means to fasten the frame to said mounting surface.

2. The exercising device as claimed in claim 1 wherein said clamping means comprises a threaded bolt, the block having a threaded hole therein, the threaded bolt threadingly engaged within the threaded hole in the block, one end of the threaded bolt being disposed in touching engagement with the surface of the ball.

* * * * *